US006018843A

United States Patent [19]

Disanza

[11] Patent Number: 6,018,843

[45] Date of Patent: Feb. 1, 2000

[54] VACUUM AND BAG SYSTEM

[76] Inventor: Paul A. Disanza, One Postbrook Rd. S., West Milford, N.J. 07480

[21] Appl. No.: 09/144,682

[22] Filed: Aug. 31, 1998

[51] Int. Cl.[7] ..... A47L 9/14

[52] U.S. Cl. ..... 15/327.2; 15/352; 15/353

[58] Field of Search ..... 15/327.1, 327.2, 15/327.6, 347, 352, 353

[56] References Cited

U.S. PATENT DOCUMENTS

| | | | |
|---|---|---|---|
| 3,740,933 | 6/1973 | Hollowell | 15/352 |
| 4,523,936 | 6/1985 | Disanza | 15/352 |
| 4,811,453 | 3/1989 | Lubraniecki | 15/352 |
| 4,838,907 | 6/1989 | Perry | 15/327.1 |

*Primary Examiner*—Terrence R. Till
*Attorney, Agent, or Firm*—Alfred C. Hill

[57] ABSTRACT

A vacuum and bag system comprising a tank of predetermined configuration having a closed end and an open end; an impervious, flexible bag disposed in the tank having an edge of an open extremity thereof draped over an edge of the open end of the tank; a removable cover having a powerhead therein, the cover being disposed to seal the open end of the tank and to entrap the edge of the open extremity of the impervious, flexible bag on the edge of the open end of the tank, the powerhead generating a negative pressure within the tank and the impervious, flexible bag when the powerhead is activated; a pickup hose disposed to extend through a selected one of the removable cover and a side wall of the tank adjacent the powerhead to pick up material and to deposit the material in the impervious, flexible bag when the powerhead is activated; and a conduit connected between an inner surface of the removable cover adjacent the powerhead and an inner surface of a selected wall of the tank externally of the tank, the conduit providing the same negative pressure on the outside of the impervious, flexible bag as the powerhead provides inside the impervious, flexible bag to maintain the impervious, flexible bag against the inner surface of the tank to enable depositing the material therein when the powerhead is activated.

19 Claims, 1 Drawing Sheet

VACUUM AND BAG SYSTEM

BACKGROUND OF THE INVENTION

The present invention relates to vacuum cleaners and more particularly to an improved shop type vacuum cleaner.

Two main types of vacuum cleaners are known at present. The first type of vacuum cleaner, which is most wide spread, includes a flexible bag which is permeable to air and which is disposed in an airtight enclosure between a suction orifice and a suction device. Air sucked by the suction device flows through the wall of the flexible bag which then acts as a filter and retains the dirt contained in the sucked-in air. Such a vacuum cleaner is not suitable for sucking up a liquid since the liquid will flow through the pores of the flexible bag, nor can it be used with damp substances which would very quickly clog the pores of the flexible bag. Further, flexible bags are either made of cloth, in which case it is necessary to empty them out in order to reuse them which is a particularly disagreeable operation to perform, or else they are made of paper, in which case they are fragile and may tear while being handled which makes it necessary to clean out the vacuum cleaner itself and to vacuum up the dirt which has fallen onto the ground.

In the second type of vacuum cleaner, a rigid receptacle is disposed in an airtight enclosure with an opening facing the suction orifice, and the suction device is disposed in a side opposite to the opening. The air sucked by the suction device flows around the rigid receptacle while the dirt is projected, generally under gravity, into the rigid receptacle. Although such a vacuum cleaner is capable of picking up wet dirt and even liquids, it is still necessary to transfer the contents of the rigid receptacle into a garbage bin. Such a device is, therefore, unsuitable for vacuuming harmful particles or substances that redisperse in the atmosphere during the handling, such as asbestos for example.

Attempts have been made to dispose an airtight flexible bag in the rigid receptacle, but it has been observed that the bag is sucked into the suction device when the device is switched on, and as a result it is not possible to use an airtight flexible bag in existing vacuum cleaners.

In addition, it has been proposed to provide a negative-pressure collection system, for collecting refuge, such as debris, particulate matter, and the like comprising a doubled wall chamber arrangement wherein the outer wall is a solid wall and the inner wall spaced from the outer wall is perforated with a flexible bag being disposed adjacent the perforated wall. A suction or negative-pressured device is provided which supplies a negative-pressure in the space between the two walls and inside the flexible bag thereby maintaining the flexible bag against the perforated inner wall to thereby collect the debris or refuge as the matter is picked up by the negative pressure.

SUMMARY OF THE INVENTION

An object of the present invention is to provide an improved vacuum cleaner employing a flexible impervious bag to collect the debris therein.

Another object of the present invention is to provide an improved shop-type vacuum cleaner into which the debris is deposited directly into an impervious plastic trash bag so that the debris picked up can be disposed of without handling the debris by merely removing the plastic bag from the tank of the vacuum cleaner after is has been filled.

A feature of the present invention is a vacuum and bag system comprising a tank of predetermined configuration having a closed end and an open end; an impervious, flexible bag disposed in the tank having an edge of an open extremity thereof draped over an edge of the open end of the tank; a removable cover having a powerhead therein, the removable cover being disposed to seal the open end of the tank and to entrap the edge of the open extremity of the impervious, flexible bag on the edge of the open end of the tank, the powerhead generating a negative pressure within the tank and the impervious, flexible bag when the powerhead is activated; a pickup hose disposed to extend through a selected one of the removable cover and a side wall of the tank adjacent the powerhead to pick up material and to deposit the material in the impervious, flexible bag when the powerhead is activated; and conduit means connected between an inner surface of the removable cover adjacent the powerhead and an inner surface of a selected wall of the tank, externally of the tank, the conduit means providing the same negative pressure on the outside of the impervious, flexible bag as the powerhead provides inside the impervious, flexible bag to maintain the impervious, flexible bag against the inner surface of the tank to enable depositing the material therein when the power head is activated.

BRIEF DESCRIPTION OF THE DRAWING

Above-mentioned and other features and objects of the present invention will become more apparent by reference to the following description taken in conjunction with the accompanying drawing, in which.

DESCRIPTION OF THE PREFERRED EMBODIMENTS

Figure 1:
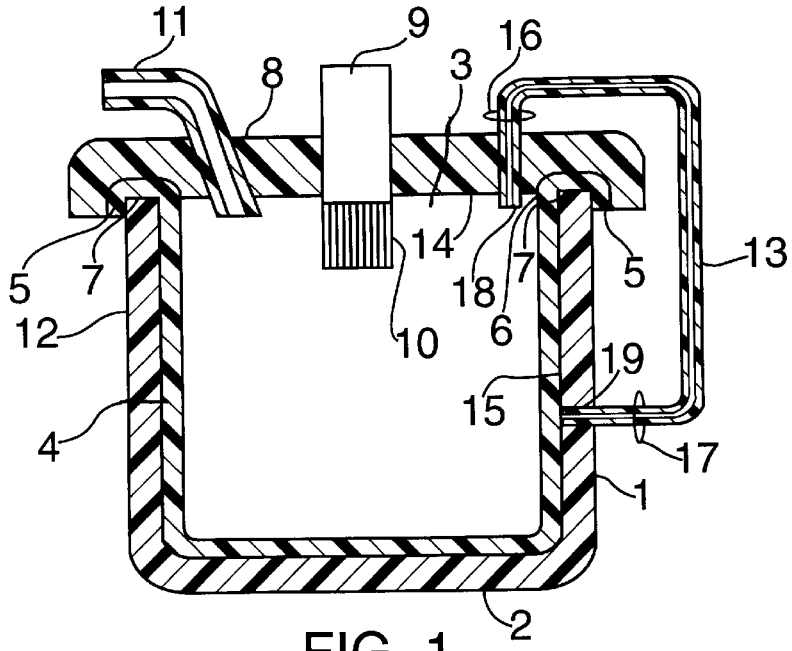
FIG. 1 is a cross-sectional view illustrating one embodiment of the vacuum and bag system in accordance with the principles of the present invention.
Figure 2:
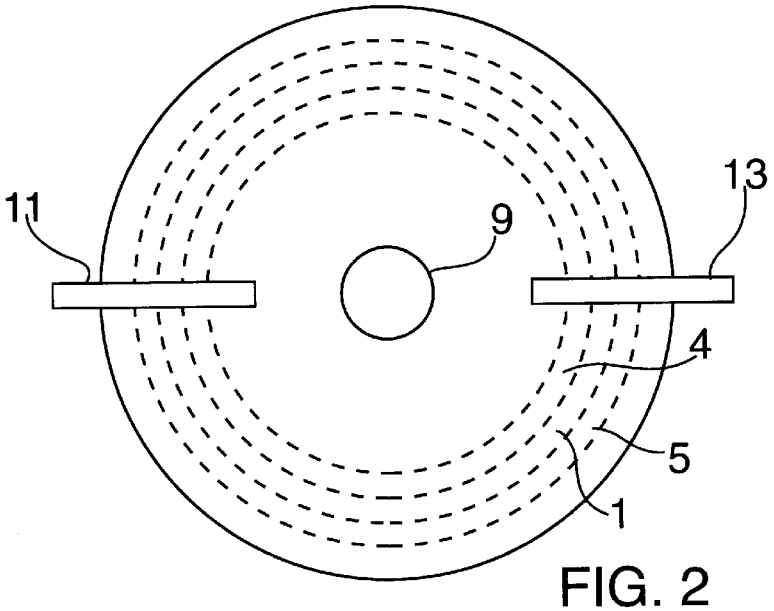
FIG. 2 is a top view of the vacuum and bag system of FIG. 1.

Referring to FIGS. 1 and 2, the vacuum and bag system in accordance with the principles of the present invention includes a tank 1 of predetermined configuration having a closed end 2 and an open end 3. As illustrated in FIG. 2 the predetermined configuration is cylindrical, but it is to be clearly understood that the vacuum and bag system may have a tank of any desired configuration, such as square or rectangular.

An impervious, flexible bag 4 is disposed in tank 1 having an edge 5 of an open extremity 6 thereof draped over an edge 7 of the open end 3 of tank 1. A removable cover 8 having a powerhead 9 therein is disposed to seal the open end 3 of tank 1 and to entrap edge 5 of the open extremity 6 of the impervious, flexible bag 4 on the edge 7 of open end 3 of tank 1. Powerhead 9 and its associated filter 10 generates a negative pressure within tank 1 and the impervious, flexible bag 4 when the power head 9 is activated.

The pick up hose 11 is disposed to extend through a selected one of the removable cover 8 and a side wall 12 of tank 1 adjacent the power head 9 to pick up material and to deposit the material in the impervious, flexible bag 4 when powerhead 9 is activated. As shown in FIGS. 1 and 2, hose 11 extends through cover 8.

A conduit means 13 is connected between the inner surface 14 of cover 8 adjacent powerhead 9 and an inner surface of a selected wall, such as wall 12 or the closed end 2 of tank 1, externally of tank 1 with the conduit 13 being illustrated in FIG. 1 as being connected to the inner surface 15 of side wall 12.

The conduit means 13 provides the same negative pressure on the outside of impervious, flexible bag 4 as the powerhead 9 provides inside the impervious, flexible bag 4 to maintain the impervious, flexible bag 4 against the inner surface 15 of tank 1 to enable depositing material therein when the powerhead 9 is activated.

The impervious, flexible bag 4 may be a plastic bag, such as a plastic trash bag, and when full the picked up material can be removed from the inside of tank 1 by removing bag 4 therefrom for disposal in a garbage container.

The conduit means 13 can be a stiff, or flexible hose externally of the tank 1. Conduit means 13 may include connectors 16 and 17 so that conduit 13 may be fastened to or disconnected from pipes 18 and 19 penetrating cover 8 and sidewall 12, respectfully. These connectors would be particularly necessary when conduit means 13 is a stiff hose.

Figure 3:
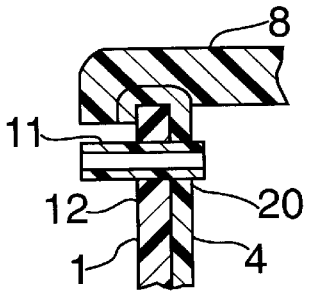
FIG. 3 is a partial cross-sectional view of a second embodiment of the vacuum and bag system in accordance with the principles of the present invention.

Referring to FIG. 3, a second embodiment of the vacuum and bag system in accordance with the principles of the present invention is shown in a partially cross-sectional view of the inventive system. In this arrangement, as mentioned previously, the pick up hose 11 is disposed through the side wall 12 of the tank 1 which passes through an aperture 20 in the impervious, flexible bag 4 so as the picked up material can be deposited in the bag 4.

The cover 8 can be secured to housing 1 by known clip arrangements not illustrated.

The conduit means 13 is employed so that the bag 4 is not sucked to the negative pressure producing means, such as powerhead 9. This is accomplished without use of internal chambers, fasteners for the bag or other hardware and results in a reduced cost of manufacturing such a vacuum and bagging arrangement.

The following are certain advantages and distinguishing elements relating to the vacuum and bag system of the present invention and existing industrial vacuum equipment. (1) All lightgauge, polyethylene or polypropolene construction versus a minimum sixteen gauge steel. (2) A powerhead that is injection or blow molded versus fabricated construction. (3) Integral, one piece plastic latches or fasteners to the collection tank 1 versus multi-piece metal fasteners. (4) A powerhead that doesn't rely on a mechanical sponge rubber gasket seals. (5) A seamless plastic tank versus a seam welded metal tank. (6) A tank that will not exceed a twenty gallon capacity versus a minimum of thirty gallon capacity. (7) An overall weight that will not exceed twenty lbs. versus a minimum of fifty lbs. (8) An overall height that will not exceed forty inches versus fifty four inch height. (9) An inlet constructed of light gauge plastic that is static generating versus all steel static conductive inlet. (10) A vacuum blower rated for a maximum airflow of eighty cubic feet of air per minute (cfm) versus a minimum airflow of one hundred cfm. (11) Commercial duty, brush type vacuum blower versus industrial versions. (12) Exposed motor armature versus enclosed motor armatures. (13) A light gauge plastic motor housing versus all steel motor housings. (14) Vacuum tank will sustain nine inches of mercury vacuum before fatiguing versus sixteen inch mercury vacuum. (15) The entire unit is portable enough for an individual to transport, lift, carry, etc. with one hand, requiring minimum effort. The industrial versions cannot. (16) The filter elements will carry no filtration efficiency rating, industrial machines are typically rated for fifty to twenty micron. (17) Overall design is not rated for industrial use. (18) A high level, liquid shutoff device not rated for industrial environments. (19) Light duty casters not capable of sustaining more than one hundred lbs. versus casters capable sustaining of one hundred forty five lb. minimum. (20) An external conduit 13 can be flexible, but a permanent part of the cover 8 versus a detachable arrangement. (21) The external conduit will originate on the dirty side of the airstream versus the clean side. (22) Filter elements may be made of non-woven membrane versus a woven membrane.

While I have described above the principles of my invention in connection with specific apparatus, it is to be clearly understood that this description is made only by way of example and not as a limitation to the scope of my invention as set forth in the objects thereof and in the accompanying claims.

I claim:

1. A vacuum and bag system comprising:

a tank of predetermined configuration having a closed end and an open end;

an impervious, flexible bag disposed in said tank having an edge of an open extremity thereof draped over an edge of said open end of said tank;

a removable cover having a powerhead therein, said removable cover being disposed to seal said open end of said tank and to entrap said edge of said open extremity of said impervious, flexible bag on said edge of said open end of said tank, said powerhead generating a negative pressure within said tank and said impervious, flexible bag when said powerhead is activated;

a pickup hose disposed to extend through a selected one of said removable cover and a side wall of said tank adjacent said powerhead to pick up material and to deposit said material in said impervious, flexible bag when said powerhead is activated; and conduit means connected between an inner surface of said removable cover adjacent said powerhead and an inner surface of a selected wall of said tank externally of said tank, said conduit means providing the same negative pressure on the outside of said impervious, flexible bag as said powerhead provides inside said impervious, flexible bag to maintain said impervious, flexible bag against the inner surface of said tank to enable depositing said material therein when said powerhead is activated.

2. A system according to claim 1, wherein said predetermined configuration is cylindrical.

3. A system according to claim 2, wherein said impervious flexible bag, is a plastic bag.

4. A system according to claim 3, wherein said conduit means is a flexible hose externally of said tank.

5. A system according to claim 3, wherein said plastic bag is a plastic trash bag.

6. A system according to claim 5, wherein said conduit means is a flexible hose externally of said tank.

7. A system according to claim 1, wherein said impervious, flexible bag is a plastic bag.

8. A system according to claim 7, wherein said conduit means is a flexible hose externally of said tank.

9. A system according to claim 7, wherein said plastic bag is a plastic trash bag.

10. A system according to claim 9, wherein said conduit means is a flexible hose externally of said tank.

11. A system according to claim 1, wherein said conduit means is a flexible hose externally of said tank.

12. A system according to claim 1, wherein said selected one of said removable cover and said sidewall of said tank is said cover.

13. A system according to claim 12, wherein said impervious, flexible bag is a plastic bag.

14. A system according to claim 13, wherein said conduit means is a flexible hose externally of said tank.

15. A system according to claim 12, wherein said conduit means is a flexible hose externally of said tank.

16. A system according to claim 1, wherein said selected one of said removable cover and said sidewall of said tank is said sidewall of said tank.

17. A system according to claim 16, wherein said impervious, flexible bag is a plastic bag.

18. A system according to claim 17, wherein said conduit means is a flexible hose externally of said tank.

19. A system according to claim 16, wherein said conduit means is a flexible hose externally of said tank.

* * * * *